US005189433A

United States Patent [19]

Stern et al.

[11] Patent Number: 5,189,433

[45] Date of Patent: Feb. 23, 1993

[54] SLOTTED MICROSTRIP ELECTRONIC SCAN ANTENNA

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 773,813

[22] Filed: Oct. 9, 1991

[51] Int. Cl.[5] ..... H01Q 13/10

[52] U.S. Cl. ..... 343/770; 343/853

[58] Field of Search ..... 343/770, 771, 700 MS File, 343/853, 754; 342/371, 372

[56] References Cited

U.S. PATENT DOCUMENTS

| | | | |
|---|---|---|---|
| 3,636,563 | 1/1972 | Laverick et al. | 343/771 |
| 4,129,872 | 12/1978 | Toman | 343/771 |
| 4,348,679 | 9/1982 | Shnitkin et al. | 343/768 |
| 4,754,237 | 6/1988 | Stern et al. | 333/1.1 |
| 4,775,866 | 10/1988 | Shibata et al. | 343/700 MS |
| 4,879,562 | 11/1989 | Stern et al. | 343/770 |
| 4,885,592 | 12/1989 | Kojal et al. | 343/774 |

FOREIGN PATENT DOCUMENTS

| | | | |
|---|---|---|---|
| 0147068 | 2/1976 | Japan | 343/770 |
| 0048804 | 9/1980 | Japan | 343/770 |

OTHER PUBLICATIONS

Collier, "Microstrip Antenna Array for 12 GHz TV", Microwave Journal, vol. 20, No. 9, pp. 67, 68, 70, 71, Sep. 1977.

Klaus Salbach, "mm-Wave Oversized Cavity Slotted Array", Microwave Journal, Jul. 1984, pp. 147-149.

*Primary Examiner*—Michael C. Wimer

*Assistant Examiner*—Tan Ho

*Attorney, Agent, or Firm*—Michael Zelenka; William H. Anderson

[57] ABSTRACT

An rf, phase-array, microstrip antenna having a slotted ground plane mounted on one surface of a dielectric substrate. A network of strip lines is mounted on an opposed surface of the dielectric substrate. The network includes eight parallel rows of coupling strip lines mounted in superposition with eight rows of radiating slots. The slots in each row form a linear array. The slot spacing in each row is uniform and is different form different rows. The network further includes an input-/output strip line, a plurality of switchable microstrip circulators and a plurality of branching strip lines connected to the circulators in a tree network. A scanning circuit is connected to the control terminals of the circulators for selectively completing an rf transmission path between the input/output strip line and the coupling strip lines. Each linear array is directional, having a major lobe, and each major lobe is oriented in a different direction. Periodic switching by the scanning circuit between the linear arrays causes the antenna to scan a region of space via the different major lobes.

13 Claims, 3 Drawing Sheets

SLOTTED MICROSTRIP ELECTRONIC SCAN ANTENNA

GOVERNMENT INTEREST

The invention described herein may be manufactured, used, and licensed by or for the Government for governmental purposes without the payment to us of any royalty thereon.

BACKGROUND OF THE INVENTION

1. Field of the Invention

The present invention relates to phase-array antennas and, more particularly, to millimeter (mm) wave, electronically scannable antennas.

2. Description of the Prior Art

A phase-array antenna is an antenna with two or more driven elements. The elements are fed with a certain relative phase, and they are spaced at a certain distance, resulting in a directivity pattern that exhibits gain in some directions and little or no radiation in other directions.

Phased arrays can be very simple, consisting of only two elements. For example, a simple phased array may be formed from two dipoles spaced a quarter wavelength apart in free space. If the dipoles are fed 90 degrees out of phase, radiation from the two dipoles will add in phase in one direction and cancel in the opposite direction. In this case, the radiation pattern is unidirectional having one major lobe. Phased arrays can have directivity patterns with two, three or more different optimum directions. A bidirectional pattern can be obtained, for example, by spacing the dipoles at one wavelength, and feeding them in phase.

More complicated phased arrays are used by radio transmitting stations. Several vertical radiators, arranged in a specified pattern and fed with signals of specified phase, produce a designated directional pattern. This is done to avoid interference with other broadcast stations on the same channel.

Phased arrays can have rotatable or steerable patterns as well as fixed directional patterns. For example, an array of antenna elements may be mounted on a rotator that physically moves the array, usually periodically, such that its major lobe scans over all points in a given space. Alternatively, the major lobe may be moved electronically by varying the relative phase which will cause the directional pattern to be adjusted.

The use of slotted antenna arrays for forming directional mm wave antennas is also well known. Slotted antenna arrays for the reception of television signals from satellite transmitters are described by Collier in "Microstrip Antenna Array for 12 GHz TV", Microwave Journal, vol. 20, no. 9, pp 67, 68, 70, 71, Sept. 1977. The Collier antennas include arrays of 2, 4, 16, 64 and 512 radiating slots formed in a conductive sheet with slot spacings of a wavelength in the H-plane and half a wavelength in the E-plane. The energy distribution feeder for each array is a strip-line branching network that forms a microstrip with the slotted conductive sheet.

A slotted array antenna designed for maximum directivity is described in "mm-Wave Oversized Cavity Slotted Array", Microwave Journal, July 1984, pp. 147–149, by Klaus Salbach. The Salbach antenna is a two-dimensional array of slotted cavities using a broad hollow waveguide that is excited by a line-source array in the form of a conventional slotted waveguide with phase reversal of the slots in order to excite the desired mode.

Electronically scannable, phase-array antennas have found wide use in radar systems such as those required for surveillance, obstacle avoidance and target acquisition. Such antennas are usually massive structures that require complex networks to properly feed the antenna elements. Although they are complex and expensive, phase-array radars are used widely because of their reliability. For example, a phase-array radar has a gradual failure mode and will continue to function even if a number of individual antenna elements fail.

Those concerned with the development of electronically scannable, phase-array antennas have long recognized the need for reducing their size, complexity and cost. The present invention fulfills this need.

SUMMARY OF THE INVENTION

The general purpose of this invention is to provide an efficient electronically scannable, phase-array antenna that is of small size, light weight, simple construction and low cost. To obtain this, the present invention contemplates a unique scanning antenna formed from a microstrip-type transmission line having a conductive sheet with a plurality of radiating slots. The slots are arranged in a plurality of rows. A waveguide couples rf energy to and from the slots. A switching circuit selectively permits rf energy to be transmitted by the waveguide to and from the slots in one of the rows while blocking the transmission of rf energy to and from the slots in the other rows.

More specifically, the present invention includes a microstrip antenna having a slotted ground plane mounted on one surface of a dielectric substrate. A network of strip lines is mounted on an opposed surface of the dielectric substrate. The network includes rows of coupling strip lines mounted in superposition with rows of radiating slots. The slots in each row form a linear array. The slot spacing in each row is uniform and is different for different rows. The network further includes an input-output strip line, a plurality of switchable microstrip circulators and a plurality of branching strip lines connecting the circulators in a tree network. A scanning circuit is connected to the control terminals of the circulators for selectively switching the circulators to complete rf transmission paths between the input/output strip line and the coupling strip lines. Each linear array of slots is directional having a major lobe, and each major lobe is oriented in a different direction due to the different slot spacings. Periodic switching of the circulators by the scanning circuit causes the antenna to scan a region of space via the different major lobes.

Other objects and features of the invention will become apparent to those skilled in the art as the disclosure is made in the following description of a preferred embodiment of the invention as illustrated in the accompanying drawings.

DETAILED DESCRIPTION OF THE PREFERRED EMBODIMENT

Figure 1:
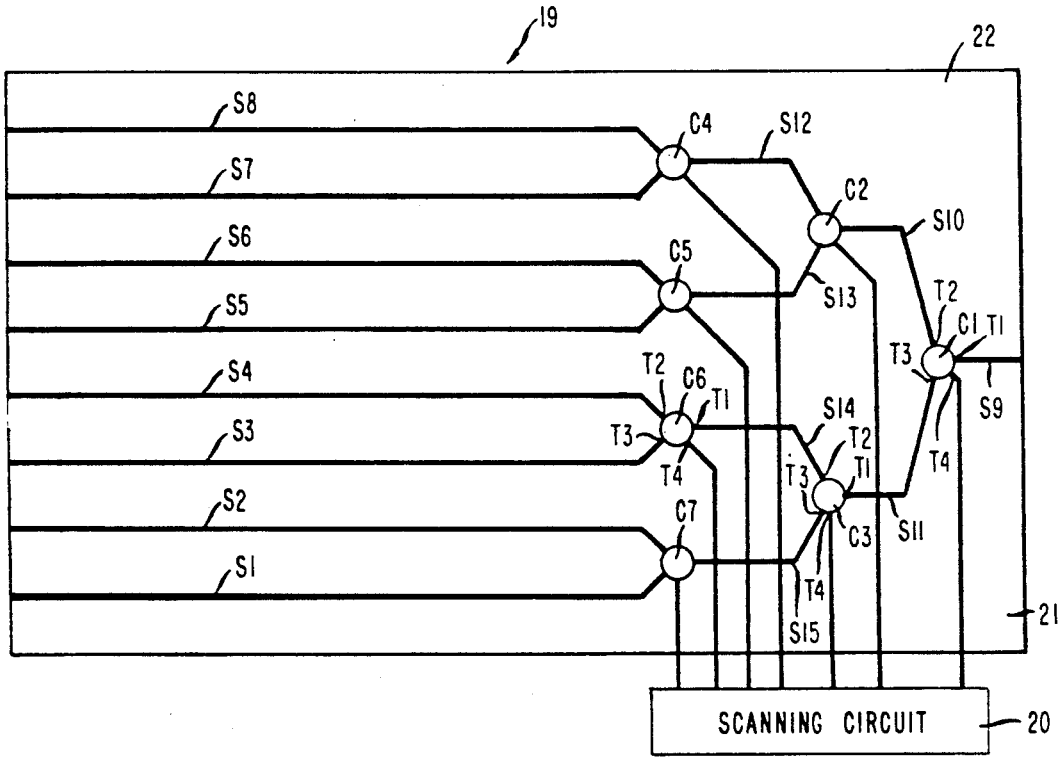
FIG. 1 is a bottom view in schematic of the preferred embodiment.
Figure 2:
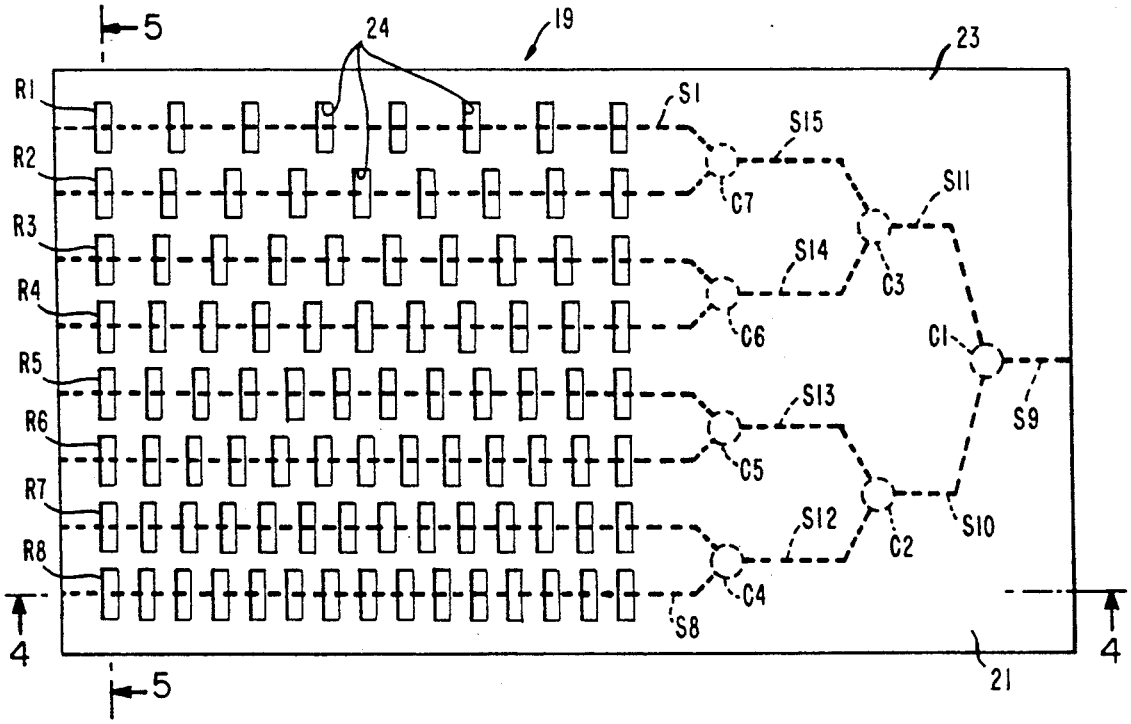
FIG. 2 is a top view in schematic of the device shown in FIG. 1.
Figure 3:
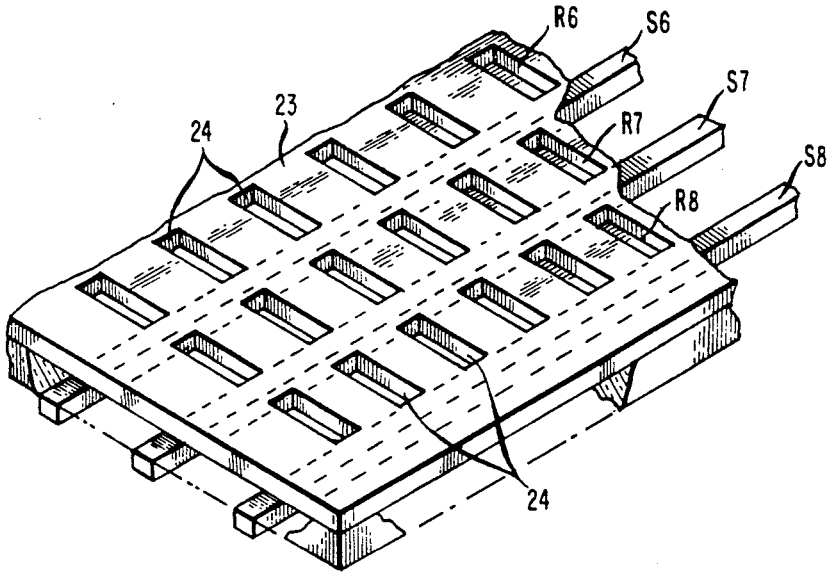
FIG. 3 is a top pictorial view with parts broken away showing a blow-up of a section of the device shown in FIG. 2.
Figure 5:
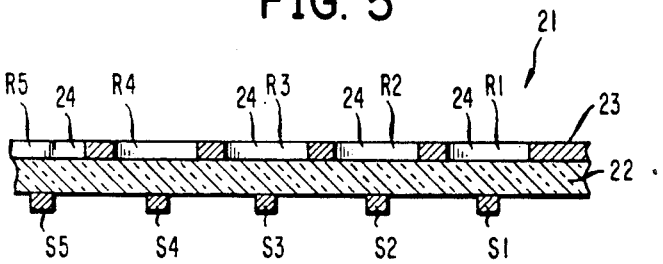
FIG. 5 is a partial cross section taken on the line 5—5 of FIG. 2, looking in the direction of the arrows.
Figure 4:
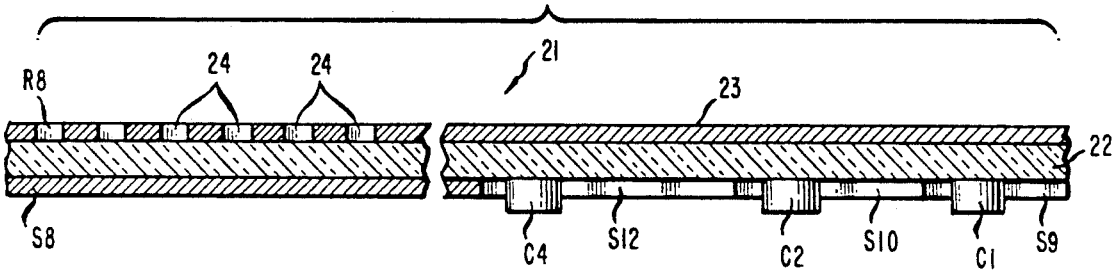
FIG. 4 is a cross section of a portion of the preferred embodiment taken on the line 4—4 of FIG. 2, looking in the direction of the arrows.

Referring now to the drawings, there is shown an electronically scannable antenna system 19 having a microstrip antenna 21 and a scanning circuit 20. The microstrip antenna 21 includes a flat dielectric substrate 22 (FIG. 1), a slotted ground plane conductor 23 (FIG. 2) mounted on one side of the substrate 22, and a tree-like network of strip lines S1–S15 mounted on the other side of substrate 22. A plurality of similarly shaped rectangular slots 24 are formed in the ground plane conductor 23. The slots 24 are arranged in eight parallel rows R1–R8. The spacing between the slots 24 in a given row is identical while the slot spacing is different for the different rows R1–R8. For the illustrated embodiment in FIG. 2, row R8 has the smallest slot spacing and row R1 has the largest slot spacing. The slot spacing increases proportionately for the adjacent rows starting from row R8 and proceeding to row R1.

The slots 24 may radiate or receive rf energy in accordance with well known principles. The dimensions of the slots 24 will be related to the center operating frequency. A detailed description of slot construction for operation at 12.0 GHz is described by Collier, cited above.

Electromagnetic energy is coupled between slots 24 and the strip lines S1–S8, which are parallel to each other and are mounted directly below the slots 24 in rows R1–R8, respectively. A plurality of switchable microstrip circulators C1–C7 interconnect the strip lines S1–S15 in a tree-like network. Circulators C1–C7 are preferably made in accordance with the teachings of U.S. Pat. No. 4,754,237, issued Jun. 28, 1988. The circulators C1–C7 each have three transmission terminals T1–T3 and a control terminal T4. The control terminals T4 of the circulators C1–C7 are connected to a scanning circuit 20. The scanning circuit 20 provides two-state switching signals for switching circulators C1–C7 via the control terminals T4 such that a signal appearing at one of the transmission terminals, say terminal T1, can be made to exit either one of the other two transmission terminals say either terminal T2 or T3. For example, a signal that is inputted to the antenna 21 via strip line S9 will exit the circulator C1 via either the terminal T2 (strip line S10) or the terminal T3 (strip line S11) depending on the state of the switching signal that scanning circuit 20 applies to the control terminal T4 of circulator C1.

With appropriate application of the switching signals from circuit 20, an input signal traveling along strip line S9 can be directed to any one of the strip lines S1–S8. For example, an input signal traveling along strip line S9 can be directed to strip line S1 by appropriately switching the circulators C1, C3 and C7 such that the signal will be directed from strip line S9 to strip line S11 to strip line S15 to strip line S1. The switching status of the other four circulators C2, C4, C5 and C6 at this time is not relevant.

In a similar fashion, input signals received by slots 24 that are traveling along the strip lines S1–S8 can be selectively segregated and directed to strip line S9. For example, a received rf signal traveling along strip line S4 toward circulator C6 can be outputted on strip line S9 by appropriately switching circulators C6, C3 and C1 via scanning circuit 20. In this case, the signal on strip line S4 will be switched onto strip line S14 via terminals T2, T1 of circulator C6, onto strip line S11 via terminals T2, T1 of circulator C3 and onto strip line S9 via terminals T3, T1 of circulator C1. The status of the circulators C2, C4, C5 and C7 is irrelevant during this period.

Figure 6:
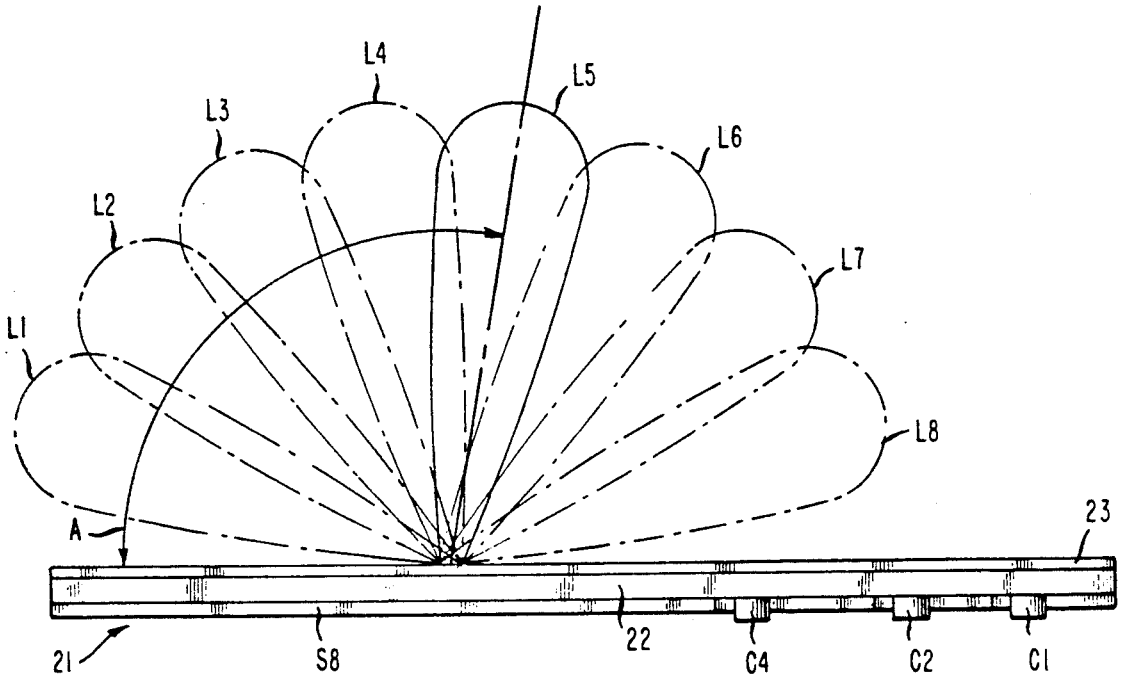
FIG. 6 is a side elevation of the preferred embodiment showing a typical radiation pattern.
Figure 7:
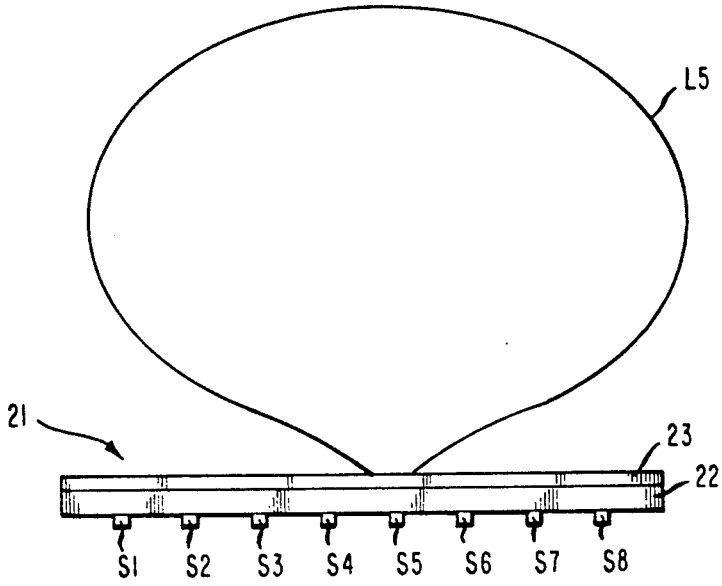
FIG. 7 is an end view of the preferred embodiment showing a typical radiation pattern.

Because each of the rows R1–R8 forms a linear phased array, each row will be highly directional. FIGS. 6 & 7 illustrate typical lobe patterns for the antenna 21. FIG. 6 shows eight typical lobes L1–L8 as viewed from the side of the antenna 21. Each of the lobes L1–L8 is associated with a different one of the rows R1–R8, respectively. The lobes L1–L8 will each be fan shaped (FIG. 7) when viewed from the end of the antenna 21. At a given operating frequency, the angle A at which a lobe is oriented will depend on the slot spacing, which is different for each of the rows R1–R8. As such, lobes L1–L8 in FIG. 6 are oriented at different angles A to represent the different radiation patterns for the rows R1–R8, respectively. With proper sequencing of the switching signals applied to circulators C1–C7 by scanning circuit 20, the lobes L1–L8 of antenna 21 can be turned on and off sequentially, thereby producing a beam-scanning effect.

Obviously, many modifications and variations of the present invention are possible in the light of the above teachings. It is therefore to be understood, that within the scope of the appended claims, the invention may be practical otherwise than as specifically described.

What is claimed is:

1. A phase-array, rf antenna comprising:

a conductive sheet having a plurality of radiating slots, said slots arranged in a plurality of rows, wherein each of said rows are arranged in a linear array and said slots are spaced in each row so as to generate a predetermined radiation pattern when rf energy is coupled to a single row and wherein said slots are spaced differently in each of said rows whereby the direction of said radiation pattern is different for each of said rows;

waveguide means for coupling rf energy to and from said rows; and switching means for selectively permitting rf energy to be transmitted by said waveguide means to and from one of said rows while blocking the transmission of rf energy to and from all other of said rows.

2. The antenna of claim 1 wherein said switching means includes a scanning circuit means for scanning said waveguide means to periodically permit rf energy to be transmitted to and from a different row of said slots whereby the radiation pattern of said antenna will scan a region of space.

3. The antenna of claim 1 wherein said waveguide includes a network of coupling strip lines.

4. The antenna of claim 3 wherein said network of coupling strip lines are spaced from said conductive sheet to form a slotted microstrip.

5. The antenna of claim 4 wherein said coupling strip lines are each mounted adjacent to a different one of said rows of slots whereby rf energy is coupled to and from the adjacent one of said strip lines and said slots.

6. The antenna of claim 5 wherein said waveguide means further includes an input/output strip line and a plurality of branching strip lines spaced from said conductive sheet to form a microstrip; and wherein said switching means includes a plurality of switchable microstrip circulator means for connecting said branching strip lines into a tree network means that is connected in parallel to said input/output strip line and said coupling strip line.

7. The antenna of claim 6 wherein said switching means further includes a scanning circuit means connected to said switchable microstrip circulators for selectively controlling said circulators to sequently provide microstrip transmission paths between said input/output strip line and successive ones of said coupling strip lines.

8. The antenna of claim 7 wherein said radiating slots in each of said rows are arranged in a linear array with uniform slot spacing whereby each of said rows of said slots has a directional radiation pattern.

9. An rf, phase-array antenna comprising:

a dielectric substrate having first and second opposed planar surfaces;

a conductive sheet mounted on said first planar surface, said sheet having a plurality of radiating slots arranged in a plurality of rows, wherein each of said rows are arranged in a linear array and said slots are spaced in each row so as to generate a predetermined radiation pattern when rf energy is coupled to a single row and wherein said slots are spaced differently in each of said rows whereby the direction of said radiation pattern is different for each of said rows;

a strip-line network mounted on said second planar surface and spaced from said conductive sheet to form a microstrip transmission line, said network including an input/output strip line, a plurality of coupling strip lines, each coupling strip line mounted adjacent a different one of said rows of said slots for coupling rf energy between said coupling strip line and said slots; and switching means for selectively completing an rf transmission path between said input/output strip line and one of said coupling strip lines.

10. The antenna of claim 9 wherein said radiating slots in each of said rows are arranged in a linear array and said rows are parallel to each other to form a two-dimensional slotted array.

11. The antenna of claim 10 wherein the slot spacing of said slots is uniform in each of said rows and is different for different ones of said rows whereby the radiation pattern for each of said rows is directional and is oriented in a different direction for different ones of said rows.

12. The antenna of claim 11 wherein said switching means includes a scanning circuit means for periodically completing said transmission paths.

13. The antenna of claim 12 wherein said strip-line network further includes a plurality of switchable microstrip circulators and a tree network of branching strip lines connected to said circulators; and wherein said switching means is connected to said circulators for controlling said circulators to selectively complete said rf transmission paths via said branching strip lines.

* * * * *